US007952460B2

(12) United States Patent
Joehren et al.

(10) Patent No.: US 7,952,460 B2
(45) Date of Patent: May 31, 2011

(54) MANUFACTURING OF AN ELECTRONIC CIRCUIT HAVING AN INDUCTANCE

(75) Inventors: Michael Joehren, Pinneberg (DE); Horst Roehm, Hamburg (DE)

(73) Assignee: NXP B.V., Eindhoven (NL)

( * ) Notice: Subject to any disclaimer, the term of this patent is extended or adjusted under 35 U.S.C. 154(b) by 14 days.

(21) Appl. No.: 12/514,281

(22) PCT Filed: Oct. 29, 2007

(86) PCT No.: PCT/IB2007/054387

§ 371 (c)(1),
(2), (4) Date: May 8, 2009

(87) PCT Pub. No.: WO2008/059392

PCT Pub. Date: May 22, 2008

(65) Prior Publication Data

US 2010/0007456 A1 Jan. 14, 2010

(30) Foreign Application Priority Data

Nov. 14, 2006 (EP) ..... 06124023

(51) Int. Cl.

| | |
|---|---|
| ***H01F 5/00*** | (2006.01) |
| ***H01F 17/04*** | (2006.01) |
| ***H01F 27/28*** | (2006.01) |
| ***H01F 27/24*** | (2006.01) |
| ***H01F 7/06*** | (2006.01) |

(52) U.S. Cl. ..... 336/200; 336/221; 336/222; 336/223; 336/229; 29/606

(58) Field of Classification Search ..... None
See application file for complete search history.

(56) References Cited

U.S. PATENT DOCUMENTS

| | | | | |
|---|---|---|---|---|
| 4,536,733 | A | 8/1985 | Shelly | |
| 4,847,986 | A * | 7/1989 | Meinel | 29/606 |
| 5,461,353 | A | 10/1995 | Eberhardt | |
| 5,469,334 | A * | 11/1995 | Balakrishnan | 361/782 |
| 6,417,754 | B1 * | 7/2002 | Bernhardt et al. | 336/200 |
| 6,512,285 | B1 | 1/2003 | Hashemi et al. | |
| 7,107,666 | B2 * | 9/2006 | Hiatt et al. | 29/602.1 |
| 7,598,838 | B2 * | 10/2009 | Hargrove et al. | 336/200 |
| 2003/0042571 | A1 * | 3/2003 | Chen et al. | 257/531 |
| 2005/0068146 | A1 * | 3/2005 | Jessie | 336/200 |
| 2005/0122198 | A1 * | 6/2005 | Zhou et al. | 336/200 |
| 2005/0170560 | A1 | 8/2005 | Weekamp | |
| 2005/0254272 | A1 | 11/2005 | Vinciarelli | |
| 2007/0085648 | A1 * | 4/2007 | Lee et al. | 336/200 |

FOREIGN PATENT DOCUMENTS

| | | |
|---|---|---|
| EP | 0649152 A | 4/1995 |
| JP | 2002-075735 | 3/2002 |
| WO | 2008/059392 | 5/2008 |

* cited by examiner

*Primary Examiner* — Anh T Mai
*Assistant Examiner* — Mangtin Lian

(57) ABSTRACT

An electronic circuit has an inductor. The inductor comprises a first number of electrically conductive tracks (108, . . . ) in, or on, a substrate (105). The tracks are separated from one another. The inductor comprises a second number of electrically conductive wires (120, . . . ). The ends of each wire contacts two different ones of the tracks. Among the first number of tracks there is at least a specific track that is electrically isolated from the wires upon the wires having been connected. Such an inductor can be made using a standardized track configuration on a substrate, and selectively skipping one or more tracks in order to determine the inductance.

11 Claims, 4 Drawing Sheets

MANUFACTURING OF AN ELECTRONIC CIRCUIT HAVING AN INDUCTANCE

RELATED APPLICATIONS

This application is related to European Patent Application No. 05112774.4, filed Dec. 22, 2005, incorporated herein by reference.

FIELD OF THE INVENTION

The invention relates to an electronic circuit comprising an inductor or a transformer, and to a method of manufacturing an inductor or a transformer for use in the circuit.

BACKGROUND ART

Manufacturing electronic circuitry that includes an inductor or a transformer poses several problems with regard to efficiently and reliably providing the inductor or transformer.

U.S. Pat. No. 4,536,733, incorporated herein by reference, discloses a low leakage inductance inverter transformer utilizing a toroidal ferrite core having a primary winding wound thereon, with the secondary winding constructed from stamped conductive clips ranged to encompass portions of the core and primary winding with clip interconnections formed by printed circuit interconnections is described. The conductive clip described includes integral pins for making connection to printed circuit wiring on a printed circuit board. The turns ratio is selected by the pattern of printed circuit interconnection of the conductive clips such that the transformer structure turns ratio is established by the associated printed circuit interconnection pattern.

U.S. Pat. No. 5,461,353, incorporated herein by reference, discloses a multilayer printed circuit board that includes a plurality of layers. Located within intermediate layer is an inductor, which is shielded by top layer ground plane and bottom layer ground plane. In another embodiment, the inductor can have its inductance adjusted by way of an inductance adjustment runner or by an electronic inductance adjustment device. The inductor is formed by interconnecting first metallization patterns located on first surface with second metallization patterns located on second surface of a printed circuit board layer.

JP 2002-075735 discloses an inductor formed by bonding pads arranged in a matrix form on a printed wiring board. Pattern arms form wiring patterns in one direction by connecting bonding pads to each other arranged in that direction. Bonding wires bond arbitrary bonding pads and constitute adjacent wiring patterns. The inductance value of the inductor element can be adjusted, by changing at least one of the lengths of the bonding wires, the lengths of the wiring patterns, and the number of the wiring patterns by selecting desired bonding pads from the bonding pads constituting the wiring patterns.

SUMMARY OF THE INVENTION

The present invention builds on aforementioned European Patent Application No. 05112774.4, not pre-published at the time of filing the current application. The not-pre-published European Patent Application discloses a method of manufacturing an inductor in an efficient and reliable manner. Basically, an inductor made according to this method is created as follows. A set of electrically conductive tracks are provided on, or in, a substrate. The tracks are electrically isolated from one another and are preferably arranged in parallel and uniform. A core material is arranged over the tracks so that the material leaves the extremities of the tracks exposed. Then, a set of conductive wires, e.g., bonding wires or, a carrier holding the wires, are arranged over the core material so that the extremities of the wires contact the exposed extremities of the conductive tracks. The two extremities of a single wire each contact a different one of neighboring tracks so that an inductor is formed.

The invention in the present application seeks to employ this method in order to increase convenience even further in the manufacturing of inductances or transformers. The invention is based on the insight that standardized ingredients can be used as follows.

As in the approach in the not pre-published application, a set of electrically conductive tracks is formed on, or in, a substrate. The tracks are electrically isolated from one another. Preferably, core material is then arranged over the tracks so as to leave their extremities exposed. Then a second number of electrically conductive wires are provided. For each respective one of the wires a respective pair of different ones of the tracks is selected. Each respective wire is then connected with the respective pair, in such a manner that there is at least one of the tracks electrically isolated from the wires upon the wires having been connected. Accordingly, the same substrate with the same arrangement of tracks can be used to create inductors with different inductances through properly selecting the tracks to be skipped, thus determining the number of the inductor's windings.

Preferably, this approach is used to create transformers using a standardized substrate. A transformer comprises two or more inductors that are magnetically coupled, for example by the core material. By properly selecting the number of windings per inductor, as specified above, the same substrate can be used for transformers of different ratios of input and output voltages.

Preferably, the second number of wires is provided as accommodated on a carrier. The wires and tracks can then be connected after properly positioning the carrier.

The invention also relates to electronic circuitry having an inductor. The inductor comprises a first number of electrically conductive tracks in, or on, a substrate that are separated from one another; and a second number of electrically conductive wires. Each of the wires contacts two different ones of the tracks; and among the first number of tracks there is at least a specific track that is electrically isolated from the wires upon the wires having been connected. The circuitry in the invention may have two or more inductors so as to include a transformer. At least one of the inductors is formed leaving one or more of the tracks isolated from the wires.

Multiple coils can be created around different sides of a ferrite core so as to have multiple inductors forming a transformer with different transfer ratios. Selecting a pair of inductors allows selecting a transfer ratio, e.g., for dynamically selecting the supply voltage by a power management device. Accordingly, the invention also relates to a circuit with a transformer that comprises, in addition to the inductor first-mentioned, at least a second inductor and a third inductor. The transformer is operative to convert an input voltage across a specific one of the first, second and third inductors into an output voltage across a specific other one of the first, second and third inductors. The circuit comprises selection means for selecting the specific inductor and the specific other inductor for thereby selecting a transfer ratio between the input voltage and the output voltage. Preferably, the transformer comprises a core of ferromagnetic material. Preferably, the core has a shape with multiple sections. Each particular one of the sections is positioned as being co-axial with a particular one of the first, second and third inductors.

For clarity, JP 2002-075735 discussed above, neither teaches nor suggests skipping tracks. Note that the known bonding pad approach may leave parasitic elements in the form of connected but un-used bonding pads. Also note that the minimum size of the bonding pads and their pitch determines the characteristics of the inductor made according to JP 2002-075735. Also note that bonding pads require expensive real estate on the substrate.

BRIEF DESCRIPTION OF THE DRAWING

The invention is explained in further detail, by way of example and with reference to the accompanying drawing, wherein.

Throughout the Figures, similar or corresponding features are indicated by same reference numerals.

DETAILED EMBODIMENTS

Figure 1:
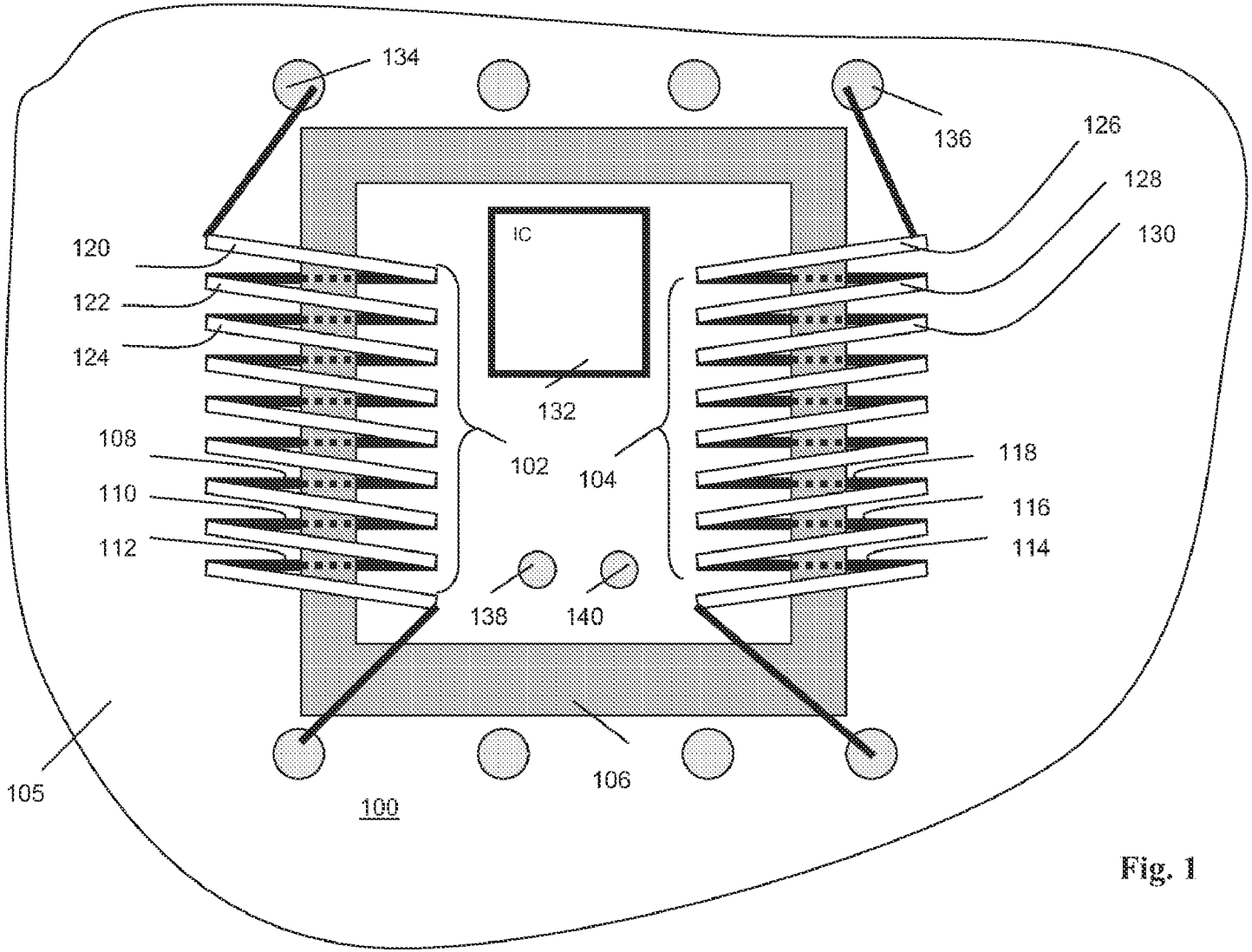
FIGS. 1 and 2 are diagrams illustrating transformers manufactured according to the invention.

In order to convert AC voltage levels or provide a magnetic coupling between two electronic circuits, a transformer is being used. A transformer comprises a primary coil and a secondary coil. The primary coil receives the input voltage to be converted and generates a varying magnetic field in the secondary coil. The secondary coil provides the output voltage. The ratio of the number of windings of these coils determines the ratio between the input voltage and the output voltage. The magnetic coupling between the two coils is increased if a magnetic core is present inside the coils to concentrate the magnetic flux. Typically a ferrite core is being used. For a power management unit in, e.g., portable electronics devices, a control circuit is used to manage the voltage transformation, to shut off the device when no power is required and also to prevent damage in case a short-circuit occurs. For interfaces such as Ethernet, DC-free signals are required, thus needing a magnetic coupling instead of a galvanic coupling.

Depending on the required voltages, the ratio between input and output voltage should be such, that the output voltage is as close as possible to the supply voltage to avoid unnecessary losses in later regulators such as low-dropout regulators (LDO's). As supply voltages can vary from device to device, multiple different transformers with different ratios are needed, and these should preferably all be based on the same footprint.

Accordingly, a simple way is needed to set the number of windings per coil around a ferrite core. Using different bonding wire configurations is a very easy way to do so. Furthermore, also DC-free, AC-coupled signals for, e.g., Ethernet can be handled using this technology.

The invention is based on the technology described in European Patent Application No. 05112774.4, referred to above, with separate coils positioned around different sides of the core. By changing the configuration of the wire connection to the tracks on the substrate (e.g., a semiconductor substrate of a PCB), the number of turns can be set individually for each coil, thus setting the ratio between the transformer's input voltage and output voltage. A circuit such as a power management controller or an electrostatic discharge (ESD) protection device, etc., can be integrated on the same PCB. Multiple coils can be wound around the different sides of the ferrite core to enable the manufacturing of transformers with different transfer ratios, so that the supply voltage can be selected dynamically by the power management device.

First the technology addressed in European Patent Application No. 05112774.4, referred to above, is described. Then examples are given to illustrate applying this technology to the manufacturing of inductors and transformers using standardized components to create such elements having different inductances and transfer ratios, respectively.

The technology referred to above comprises a method for manufacturing a microelectronic device having a core element and at least one electrically conductive conductor arranged around the core element. A well-known example of such a microelectronic device is a transformer comprising a core element and at least one coil having electrically conductive wires which are positioned around the core element. In many such microelectronic devices, it is advantageous for the core element to have no free ends and to be shaped like a closed ring, for example. However, in miniaturized devices, it is difficult to manipulate the wires of the coil in the space enclosed by the core element. Aforesaid method comprises following steps. A substrate is provided having a supporting surface and a pattern of electrically conductive tracks in or on the supporting surface. A core element is provided as well as one or more electrically conductive wires. The wires are connected to the tracks of the electrically conductive pattern at the substrate. The spatial relationship is such that the core element is arranged between the tracks and the wires. The windings of the coil are realized on the basis of the tracks and wires. With respect to the shape of the wires, it is noted that it is possible for the wires to be bent to a U-form prior to being positioned with respect to the supporting surface of the substrate and being connected to the tracks. However, it is also possible that the wire is more or less automatically bent to a suitable U-shape or C-shaped form in the process of connecting the ends of the wire to the tracks.

When the method is applied for the purpose of manufacturing a microelectronic device having at least one electrically conductive coil, the coil is obtained by providing a substrate having an electrically conductive pattern which comprises a number of tracks extending next to each other, and connecting a number of electrically conductive wires to the tracks in order to form the coil. Each wire is connected to two different tracks by connecting one end portion of the wire to one of the tracks and connecting another end portion of the wire to another of the tracks. The coil is obtained in a simple manner, namely by providing a number of tracks and wires, and connecting the ends of each wire to different tracks. This offers a possibility of obtaining at least two co-axial coils, namely by connecting each wire to tracks between which at least one other track is extending.

The substrate does not need to be part of the microelectronic device. The method may comprise further steps, namely steps of applying material to the supporting surface of the substrate and of partially removing the substrate. The step of applying material to the supporting substrate may be carried out by using any suitable type of known technique, for example, a technique known as over-molding. The material which is applied for covering the supporting surface and everything that is arranged on this surface may be any suitable material, and may comprise epoxy. The step of partially removing the substrate may also be carried out by using any suitable type of known technique, for example wet chemical etching. This is especially applicable in case the substrate comprises a metal such as copper.

With respect to the core element, it is noted that according to a preferred embodiment a shape of the circumference of the cross-section of the core element and the shape of the bent wires are adapted to each other. This has the advantage that the wires may extend a relatively short distance from the core element, and a good magnetic coupling between the windings of the resulting coil and the core element is obtained. The cross-section of the core element may be shaped like a trapezium, for example, with the top surface smaller than the base surface. In a suitable embodiment, the core element comprises ferrite.

Furthermore, especially in case material is to be applied on the supporting surface of the substrate, it is preferred that the core element comprise studs, by means of which the core element is placed on the supporting surface. As a result of the presence of the studs, there is some space between the supporting surface and the core element, so that material is allowed to flow around the core element without the risk of air bubbles getting trapped. In this way, the reliability of the process is improved.

The wires applied in above process may have an insulating layer, but this is not necessary. In case a number of wires are applied, and the wires are not insulated, it is important to take measures aimed at preventing the creation of short circuits. For example, a practical measure involves coating at least the portion of the core element with electrically insulating material. In this manner, the wires are prevented from forming a short circuit via the core element.

The core element is positioned between the tracks and the wires, preferably prior to the step of positioning the wires. As a result, it is possible for the core element to consist of only one physical piece, and to have any suitable shape, for example the shape of a fully closed ring.

In general, in case the microelectronic device is provided with a microelectronic element such as a controller die or the like, such microelectronic element is placed on the supporting surface of the substrate and is connected to the electrically conductive pattern of the substrate. In particular, in case a ring-shaped core element is provided, it is advantageous to use the space enclosed by the core element for accommodating the microelectronic element.

There are various ways of positioning the wires and establishing connections between the wires and the tracks. According to a first embodiment, the wires are connected to the tracks by means of wire-bonding. In the process, the core element is positioned over the tracks first, while leaving end portions of the tracks exposed. Subsequently, the wires are arranged over the core element, and the wires area connected to the track by means of wire-bonding.

In a preferred embodiment, the substrate is a layered substrate. The layered substrate comprises a top layer of tracks arranged on the supporting surface and an embedded layer of tracks arranged below the level of the supporting surface. The embedded tracks are accessible from the side of the supporting surface. In the process of manufacturing a microelectronic device using the layered substrate, groups of wires are provided, wherein the wires of each group are connected to the tracks of each layer. In this way, in a given space, more windings of a coil are obtained. In case the wires do not have an insulating layer, it is preferred that wires which are connected to tracks of different layers are given different shapes in order to prevent the creation of short circuits.

According to a second embodiment with respect to the positioning of the wires relative to the tracks and connecting the wires and the tracks to each other, the wires are provided on a carrier. The carrier is pre-shaped, preferably along with the wires, so as to match the shape of the core element's cross section. The carrier can be made so that it can be removed, entirely or partially, after the wires have been connected to the tracks. By using the carrier it is very easy to handle the wires and to put the wires into a proper position relative to the tracks. The carrier may comprise any suitable material, and may be at least partially removable in any suitable way. For example, the carrier comprises aluminum, and the carrier is at least partially removed by wet chemical etching. Alternatively, the carrier comprises an electrically isolating material, such as a plastic, that can stay in place to isolate the wires from the rest of the environment. Especially in case a number of wires which are relatively thin are applied, it is advantageous to have a carrier for supporting and spacing the wires. The combination of carrier and wires may be obtained in various manners. For example, a sheet is provided covered with electrically conductive wires. The carrier is then obtained by cutting a piece of this sheet.

In many applications, it is preferred to manufacture the microelectronic device as part of an array of electronic devices, wherein separate microelectronic devices are eventually obtained by dicing. In such a case, the carrier may be provided as part of a larger sheet carrying groups of electrically conductive wires. In such a case, the desired bent shape of the wires may easily be obtained by partially cutting out portions of the sheet carrying the wires, and bending or otherwise pre-forming these portions.

Furthermore, in case the microelectronic device is manufactured in an array of multiple microelectronic devices, it is advantageous if the substrate is part of a larger sheet carrying a number of patterns of electrically conductive elements.

The microelectronic device according obtained using above approach may be any microelectronic device having a core element and electrically conductive windings arranged around the core element. For example, the microelectronic device is an inductor or a transformer suitable for suppressing unwanted signals in data lines or for converting voltages. As other examples, the microelectronic device is an antenna, an integrated device such as a USB protection device, an interconnect clip for power semiconductors, or a bio-sensing device. Numerous applications exist for the microelectronic element, for example in mobile phones, digital cameras, computers and MP3 players. A specific example of a microelectronic device that can very well be manufactured in the above-described manners is a bio-sensing device, in particular a bio-sensing device in which electrically conductive wires are needed that extend above a surface. In this respect, it is noted that in bio-sensing devices configured for applying a GMR (Giant Magneto Resistive) based sensing technique, magnetic beads can be guided under the influence of currents in wires arranged above a surface.

Figure 2:
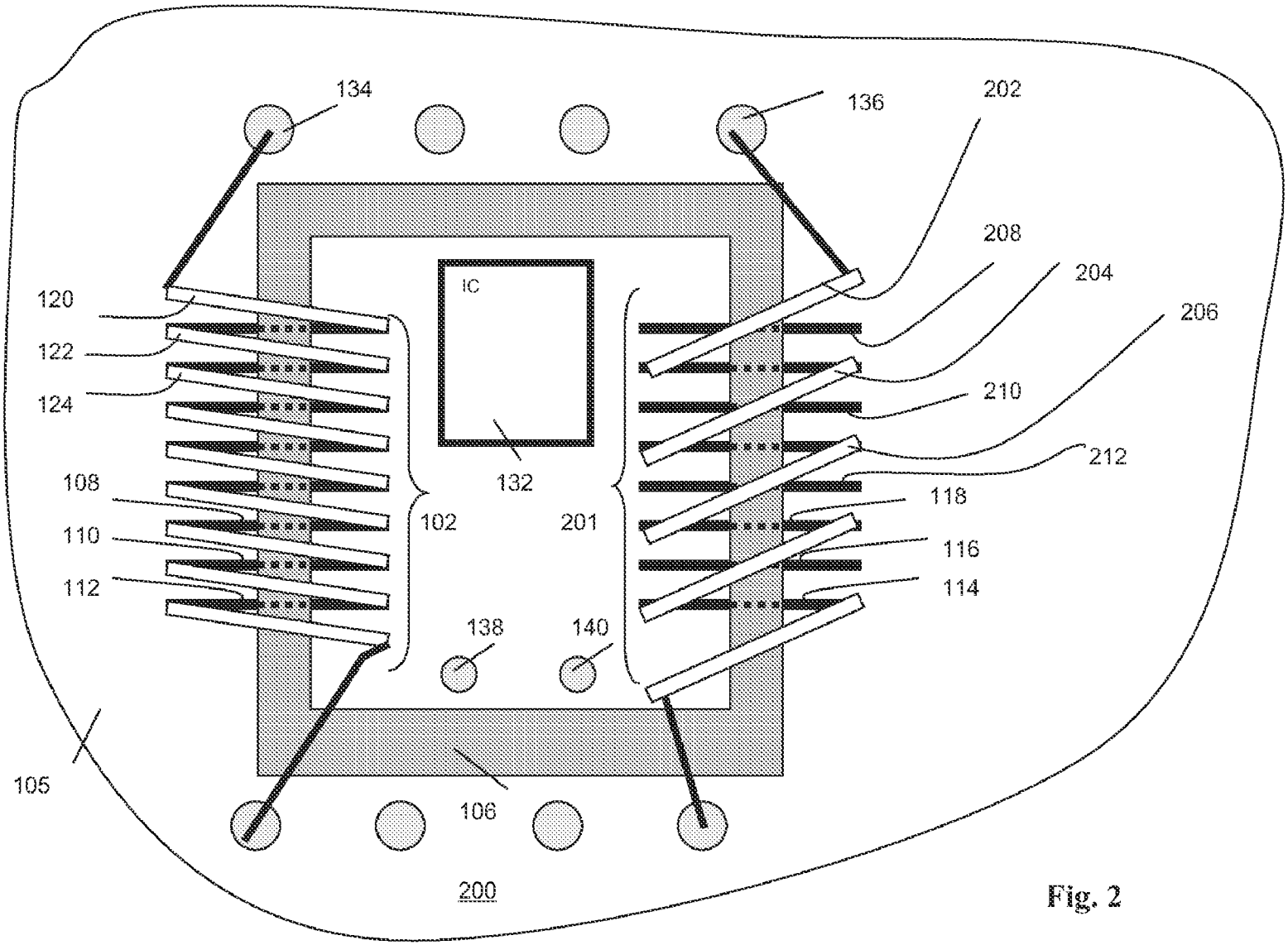

FIGS. 1 and 2 are diagrams illustrating transformers 100 and 200 made in the invention using a standardized approach.

With reference to FIG. 1, transformer 100 comprises a primary coil 102, a secondary coil 104, and a core 106, e.g., a ferrite core, that magnetically couples coils 102 and 104 with one another. Coils 102 and 104 are made on a substrate 105 as follows. First, a plurality of electrically conductive tracks is formed in, or on, substrate 105, or substrate 105 already comprises the tracks. In order to not obscure the drawing, only tracks 108, 110 and 112 have been indicated for coil 102, and tracks 114, 116 and 118 for coil 104. The material for core 106 is then arranged over tracks 108-118, leaving their extremities exposed. Then wires are provided over core 106, each contacting the extremities of different ones of tracks 108-118. Again, in order to not obscure the drawing, wires 120, 122 and 124 have been indicated for coil 102, and wires 126, 128 and 130 have been indicated for coil 104.

Wires 120-124 may be pre-formed in a U-shape in a module in order to position the wires through positioning the module. Similarly, wires 126-130 may be pre-formed in a U-shape in another module. Note that the orientation of the wires in the module is such that when the module is placed over core 106, there is only a single contact between a specific one of the wires and one of the tracks so as to form an inductor. Note that within toroidal core 106, additional circuitry can be positioned such as integrated circuit 132. Also shown are larger bonding pads, such as pads 134 and 136 outside the perimeter of core 106, and smaller bonding pads within the perimeter, such as pads 138 and 140. The larger pads are provided for connection to elements outside the perimeter of core 106, e.g., for connection to coils 102 and 104 as shown. The smaller pads are provided for connection to circuitry to be positioned within the perimeter, such as IC 132. Note that pads 134, 136, as well as pads 138 and 140 occupy relatively large real estate. Especially with regard to the region enclosed by core 106, it is advantageous to minimize the area occupied by bonding pads. Accordingly, instead of connecting wires 120-124 and 126-130 to the relevant tracks through bonding pads, it is preferred to use other means. For example, wires 120-130 could be made of solder and be located e.g., in the top part of a pre-formed casing and soldered to the tracks during the sealing of the casing to substrate 105. Alternatively, wires 120-130 could directly be soldered to the connection point of tracks 108-118. This can be done by using conventional soldering technologies, thermo-sonic technologies, or just high pressure to create an electrical connection between relevant ones of wires 120-130 and relevant ones of tracks 108-118.

Preferably, the tracks are uniform and are arranged in parallel to each other. This facilitates the connecting to the wires if the wires have been pre-formed. This is explained further below with reference to FIG. 3.

Referring to FIG. 2, transformer 200 is created in a way similar to transformer 100 in FIG. 1, but differs in the spatial configuration of secondary coil 204. The same number of tracks is being used for secondary coil 201 here as for secondary coil 104 in FIG. 1. A smaller number of wires are now being used for secondary coil 201, among which are indicated wires 202, 204 and 206. In creating secondary coil 201 by connecting the wires to the relevant tracks, several of the tracks are being skipped, among which are tracks 116, 208, 210 and 212, that remain isolated from transformer 200 and do not form a functional part thereof. Accordingly, transformers 100 and 200 can be created using the same substrate with the same number of tracks, the same core, the same wire configuration for primary coil 102, but a different wire configuration for secondary coils 104 and 201.

Figure 3:
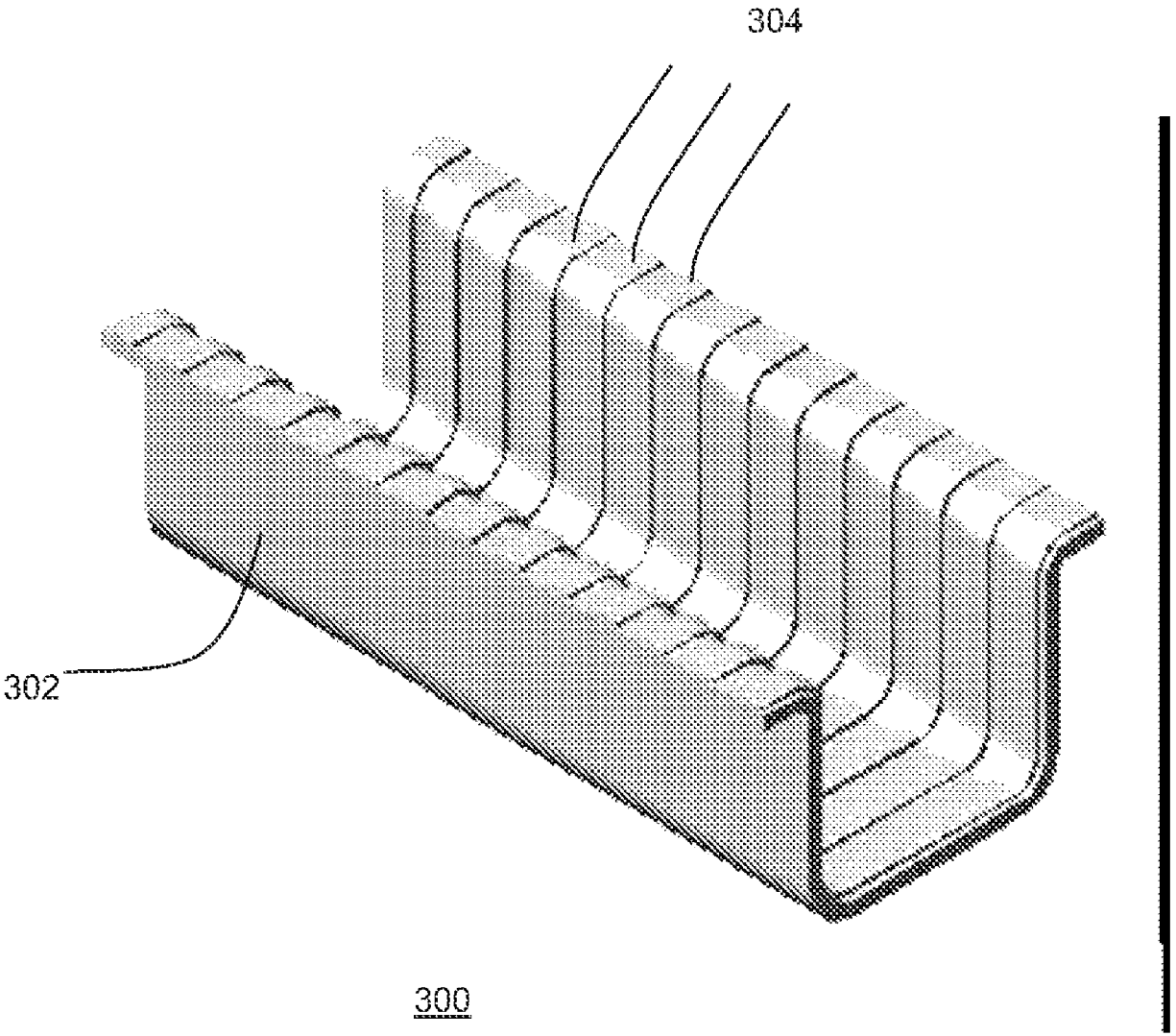
FIG. 3 is a diagram of an element used to position the wires correctly with respect to the tracks in order to form an inductor.

FIG. 3 is a diagram showing an example of an element 300 for positioning the wires (e.g., wires 120-124; wires 126-130; wires 202-206) correctly relative to the tracks (e.g., tracks 108-112; tracks 114-118; tracks 208-212) in order to form an inductor on substrate 105. Element 300 comprises a carrier 302 having a lateral cross-section in the shape of the letter C or U. On the inside of carrier 302 wires 304 are provided that are separate from one another and run in parallel to one another. Wires 304 adopt a form dependent on the shape of carrier 302 and on their orientation relative to carrier 302. The diagram shows the orientation of the wires as being perpendicular to the longitudinal direction of carrier 302. This is by way of example only. Based on what has been discussed above, the proper shape of wires 304 and their orientation with respect to carrier 302 are determined by the length, width, pitch and orientation of adjacent ones of the tracks relative to the core such as core 106, and by the core's size and cross section. Preferably, the tracks are uniform, and have been arranged in parallel to one another with equal pitch (distance between adjacent tracks). Preferably the main direction of each track runs in a direction different from perpendicular with regard to a main direction of the core material covering the tracks and leaving their extremities exposed. In this manner, element 300 is relatively simple to construct as wires 300 can be kept running in a direction perpendicular to the longitudinal axis of carrier 302, and only their pitch needs to be considered for creating coils with different inductances. Carrier 302 could be made of any suitable electrically isolating material, e.g., an elastic material for a snapping-on fit on substrate 105, thus combining isolation functionality with the functionality of being reversibly deformable for attaching it to a matching receptacle at substrate 105, etc. Also, see the patent documents on Applicant's on flexible foil connection technologies e.g., US 20050170560, herein incorporated by reference.

Figure 4:
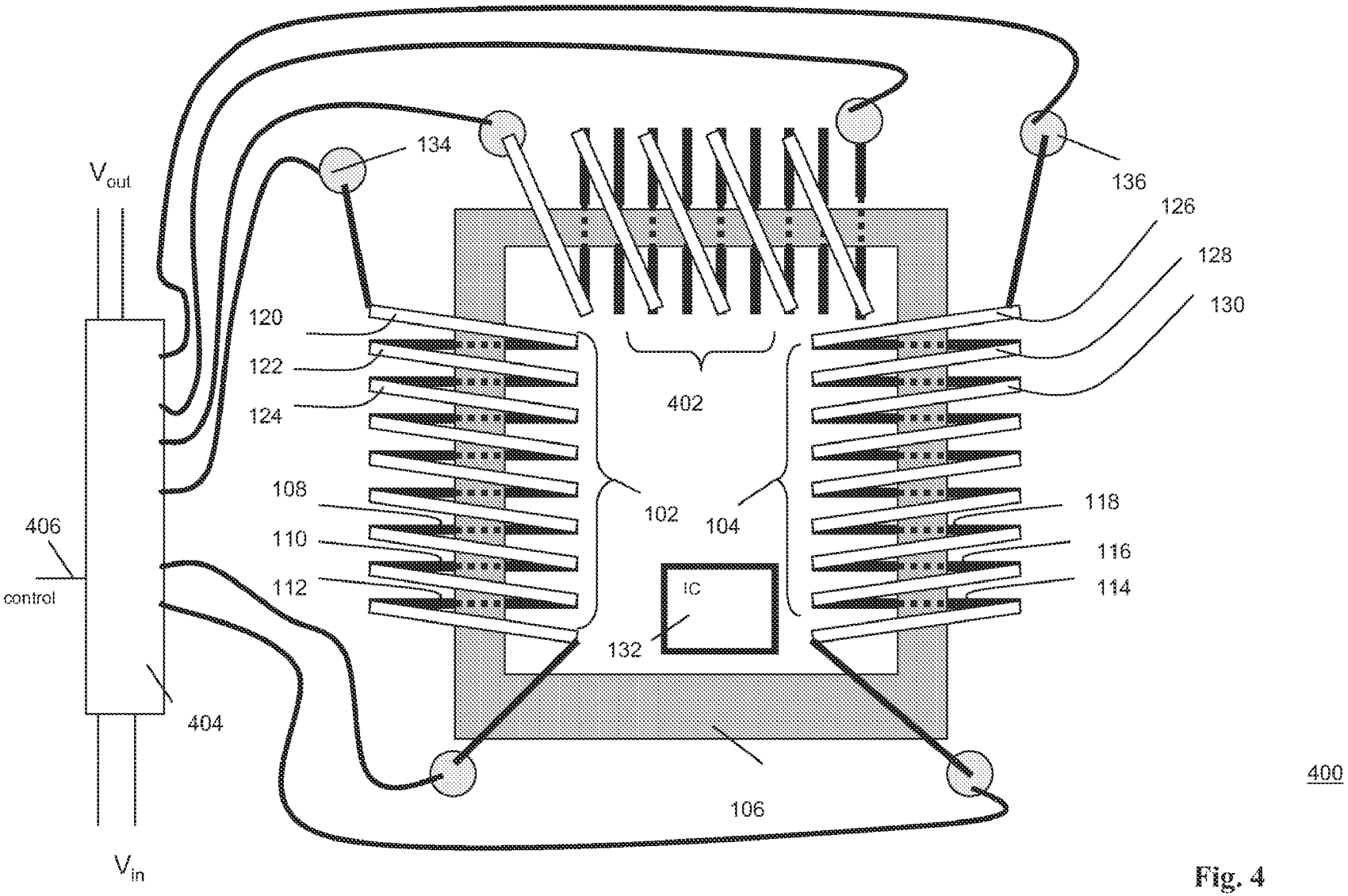
FIG. 4 is a diagram illustrating a power management circuit using a transformer of the invention.

FIG. 4 is a diagram of a circuit 400 using the transformers made in accordance with the invention. Power management device 400 has multiple inductors 102, 104 and an inductor 402 created around different sides of ferrite core 106. It is assumed here that inductors 104 and 402 have different inductances. This configuration forms the basis for a transformer with different transfer ratios. Selecting a pair of inductors, e.g., inductors 102 and 104, to configure the transformer selects a specific transfer ratio between input and output, dependent on, among other things, the number of windings per individual one of inductors 102 and 104. Selecting another pair of inductors, e.g., inductors 102 and 402, creates a transformer with another transfer ratio. Device 400 further comprises selection means 404 for selecting a specific one of inductors 102, 104 and 402 for receiving an input voltage $V_{in}$ and selecting a specific other one of inductors 102, 104 and 402 for supplying an output voltage $V_{out}$, wherein the values of $V_{in}$ and $V_{out}$ determine the transfer ratio. Selection is accomplished through a control signal at input 406. Selection means comprises, e.g., a plurality of pair-wise controlled switches that selectively connect one of inductors 102, 104 and 402 to the input of selection means 404 for receiving input voltage $V_{in}$, and another one of inductors 102, 104 and 402 to the output of selection means 404 for supply of output voltage $V_{out}$. Thus, selection means 404 selects a transfer ratio between the input voltage and the output voltage.

The invention claimed is:

1. A method of manufacturing an electronic circuit, the method comprising:

providing a substrate that has a first number of electrically conductive tracks therein or thereon, that are electrically isolated from one another;

providing a second number of electrically conductive wires on a carrier;

positioning the carrier on the substrate; and forming an inductor by connecting each respective one of the wires with a respective pair of the electrically conductive tracks in such a manner that there is at least one of the first number of electrically conductive tracks electrically isolated from the second number of electrically conductive wires and respectively located between two tracks of one of the respective pairs upon the wires having been connected.

2. The method of claim 1, wherein the circuit comprises a further inductor, the inductor and the further inductor forming a transformer, wherein the further inductor is formed by the steps of:

providing the substrate that has a third number of electrically conductive further tracks therein or thereon electrically isolated from one another;

providing a fourth number of electrically conductive further wires;

for each respective one of the further wires, selecting a respective further pair of different ones of the further tracks; and forming the further inductor by connecting each respective further wire with the respective further pair.

3. An electronic circuit, comprising:

a transformer including at least a first inductor, a second inductor, and a third inductor, the first inductor having:

a first number of electrically conductive tracks in, or on, a substrate that are separated from one another; and a second number of electrically conductive wires, each of the wires coupled to two different ones of the tracks in such a manner that at least one of the tracks is electrically isolated from the first number of electrically conductive wires and located between two of the first number of electrically conductive tracks that are coupled to one of the second number of electrically conductive wires; and a selection circuit configured to select an input inductors from a group of inductors including the first, second, and third inductors and select an output inductor, different from the input inductor, from the group of inductors to convert an input voltage across the input inductor into an output voltage across the output inductor.

4. The method of claim 1, wherein the first number of electrically conductive tracks are arranged width-wise in a row on the substrate.

5. The method of claim 4, wherein the distance between each pair of adjacent tracks in the width-wise row is the same.

6. The method of claim 4, wherein the first number of electrically conductive tracks are the same length.

7. The method of claim 4, wherein all of the second number of electrically conductive wires are the same length.

8. The method of claim 1, wherein the at least one of the first number of electrically conductive tracks includes an electrically conductive track located between each adjacent pair of electrically conductive tracks forming the inductor; and the method further including forming a second inductive interleaved with the first-mentioned inductor by:

providing a third number of electrically conductive wires; and connecting each respective one of the third number of wires with a respective pair of the at least one of the first number of electrically conductive tracks.

9. The method of claim 8, wherein the first-mentioned inductor and second inductor form part of a transformer.

10. The method of claim 9, wherein the first number of electrically conductive wires is different than the third number of electrically conductive wires.

11. The method of claim 9, further including, providing a ferromagnetic core in the transformer material.

* * * * *